US006129300A

United States Patent [19]

Heukamp et al.

[11] Patent Number: 6,129,300

[45] Date of Patent: Oct. 10, 2000

[54] BLOW BAR FOR IMPACTORS

[75] Inventors: Volker Heukamp, Lengerich; Gerhard Hemesath, Havixbeck, both of Germany

[73] Assignee: Noell Service und Maschinentechnik GmbH, Langenhagen, Germany

[21] Appl. No.: 09/271,761

[22] Filed: Mar. 18, 1999

[30] Foreign Application Priority Data

Mar. 26, 1998 [DE] Germany ..... 198 13 308

[51] Int. Cl.[7] ..... B02C 13/28

[52] U.S. Cl. ..... 241/191; 241/195; 241/294

[58] Field of Search ..... 241/294, 191, 241/195

[56] References Cited

U.S. PATENT DOCUMENTS

| | | | |
|---|---|---|---|
| 4,714,207 | 12/1987 | Schrodl | 241/195 |
| 5,004,169 | 4/1991 | Ostergaard | 241/294 |
| 5,042,733 | 8/1991 | Hench | 241/294 |
| 5,320,292 | 6/1994 | Smith | 241/195 |

FOREIGN PATENT DOCUMENTS

| | | |
|---|---|---|
| 0 666 111 | 8/1995 | European Pat. Off. . |
| 17 45 885 | 5/1957 | Germany . |
| 26 06 000 | 8/1977 | Germany . |
| 28 11 376 | 9/1979 | Germany . |

*Primary Examiner*—Mark Rosenbaum
*Attorney, Agent, or Firm*—Michael J. Striker

[57] ABSTRACT

The invention concerns blow bar 1 for impactor rotors with a mirror-symmetrical longitudinal cross-section for the purpose of reversibility, which is fitted in peripheral recesses 17 of the rotor advantageously comprising discs 16. According to the invention, the cross-section of blow bar 1 essentially forms a basic double trapezium shape with the wide bases of each trapezium as symmetrical axis 2. The rear 5 of the blow bar corresponding to the height of each trapezium is arranged at rightangles to the symmetrical axis and forms a level surface 6 over the total height of the blow bar. The invention also specifies an advantageous rotor for such a blow bar, Fig.

8 Claims, 2 Drawing Sheets

BLOW BAR FOR IMPACTORS

BACKGROUND OF THE INVENTION

The invention relates to a blow bar for impactors which, for the purpose of reversibility, has a mirror-symmetrical longitudinal cross-section and features surfaces at the rear as viewed in the rotation direction of the rotor, by means of which the blow bar is supported to the rear and radially from the inside against retaining pieces securely provided on the rotor, and at the front with contact surfaces for movable retaining pieces which hold the blow bar in engagement with the retaining pieces securely provided on the rotor.

Such blow bars which are reversible but not turnable around their longitudinal axis are known in various design forms. They are particularly suited to impactor rotors which comprise a plurality of discs secured on an axle and provided circumferentially with peripheral recesses in which the blow bars are inserted. With such rotors, the inner halves of the blow bar fronts between the discs are also exposed to wear, so that these surfaces cannot be used as support surfaces at the rear. On reversal, i.e. pivoting around a central transverse axis, the rear stays at the rear and the front at the front, only the inner half is then outside and vice versa.

In the vicinity of the disc width, the front support surfaces of the blow bars are adequately protected against wear by the retaining pieces holding them in position or by the leading, more outwardly located rotor disc sections forming the blow bar holder.

Such a blow bar is known, for example, from DE- 26 06 000 A1. Like many other known blow bars, it has a longitudinal cross-section of uniform width; in contrast to other blow bars, however, its cross-section features a rearwardly-angled shape, whereby it is obliquely supported from the inside with the rear surfaces near to the symmetrical axis in contact with appropriately designed rotor disc sections. The blow bar is held in engagement with these parts at the front by wedges which act on the contact surfaces of the blow bar provided centrally at the front vertical and to the symmetrical axis. The contact surfaces for the wedges in the rotor discs at the front are essentially radially aligned.

The cross-section of the known blow bar has a uniform width and thus contingent thereon a wide outer surface area which is essentially exposed to friction wear. A decisive factor for good comminution is the front edge of a blow bar, which should be slightly inclined forward for improved effect. Through such an incline, however, the outer surface area increases further, meaning even more friction wear.

The ideal blow bar would be as thin as possible, as is approximate to that known from DE- 28 11 376 A1. The blow bar described therein is at the most 40 mm thick over a considerable part of its height and hence only suitable for sand impactors where the size of the feed material is relatively small. In addition, this known blow bar is designed for reversible operation, which means that the impact edge is self-whetted by wear. Such a blow bar is unsuitable for large impactors, it would fracture under the load of correspondingly larger feed material.

SUMMARY OF THE INVENTION

The aim of the invention is to create a blow bar with the simplest of cross-sections which, however, is relatively thin in the vicinity of the impact edges, but which can nevertheless withstand the powerful forces generated by the effects of impact, which features favourable wear curves and thus leads to operational cost savings. A further aim is to design the blow bar and the rotor accommodating the same in such a way that, despite the simple blow bar cross-section and simple rotor design, a safe and favourably priced securing system is effected for the requisite number of blow bars in the rotor. This problem is solved as follows: the cross-section of the blow bar is essentially a double trapezium shape with the long bases as symmetrical axis, whereby the rear of the blow bar corresponding to the height of the each trapezium is designed at rightangles to the symmetrical axis to form an even surface above the height of the blow bar, and the contact surfaces at the rear of the blow bar are designed with a groove-type recess running in the longitudinal direction of the blow bar at a level with the symmetrical axis.

The blow bar according to the invention is relatively slender and thus has a correspondingly small volume, hence is also relatively cheap to manufacture with respect to cast material requirement.

In a further embodiment of the invention, the longer bases of the trapezium corresponding to the symmetrical axis are approximately twice as long as the short bases corresponding to width of the outer surfaces. In this case, trapezium or double trapezium refers to the basic shape of the cross-section, ignoring the groove-type recess. The latter is likewise designed as a trapezium (obelisk)and features level contact surfaces by means of which the blow bar is supported against the retaining pieces provided securely on the rotor.

For the securing of the blow bar in the axial direction, a further embodiment of the invention proposes that on the front faces and starting from the rear of the blow bar, the groove-type recess be widened by providing recesses to accommodate axially effective interlocking elements.

It is advantageous if the contact surfaces for the movable retaining pieces on the front of the blow bar are formed by the actual oblique sides of the double trapezium body as obelisk. Doing without separate raised or sunken surfaces results in cost savings, whereby machining of the contact surfaces can be dispensed with, since the blow bar fitted in the rotor is held by the movable retaining pieces against the retaining pieces securely provided on the rotor, preferably without tightly clamping the blow bar.

A further embodiment of the invention provides for the use of the blow bar according to the invention, whereby each blow bar is slantingly fitted around its longitudinal axis in the rotation direction of the rotor in such a way that the outwardly-directed oblique side of the corresponding trapezium as obelisk forming an impact surface is forwardly inclined with respect to a sectional plane passing through the rotor axis on the outermost edge of the blow bar forming the impact circle when the rotor is turning, so that this outermost edge is leading vis a vis the other parts of the blow bar.

Particularly advantageous is a rotor comprising a plurality of rotor discs which are interrupted by peripheral recesses in all rotor discs arranged in alignment with each other, with blow bars according to the invention, whereby the peripheral recesses as known from EP-0 666 111 A1 and starting from the outer circumference of the rotor opposite to the rotation direction of the rotor are inwardly inclined and whereby the peripheral recesses are overlapped by retaining pieces securely provided on the rotor to form a support for the blow bars, so that each blow bar is fitted inclined around its longitudinal axis in the rotation direction of the rotor in such a way that the front of the outwardly-directed oblique side of the corresponding trapezium body as obelisk forming an impact surface is forwardly inclined with respect to a sectional plane passing through the rotor axis on the outermost edge of the blow bar forming the impact circle when the rotor is turning, so that this outermost edge is leading vis a vis the other parts of the blow bar, whereby the movable retaining pieces provided between the front of the blow bars and the supporting surfaces of the rotor slantingly retain the blow bars supportively from the front and from the inside in engagement with the prism-shaped retaining pieces securely provided on the rotor.

A disadvantage of a rotor according to EP-0 666 111 A1 is that the rear support which overlaps each peripheral recess is created by loose retaining pieces with small contact surfaces, so that positive retention is not guaranteed.

BRIEF DESCRIPTION OF THE DRAWING

In the drawing, the invention is illustrated as follows.

DESCRIPTION OF PREFERRED EMBODIMENTS

Figure 1:
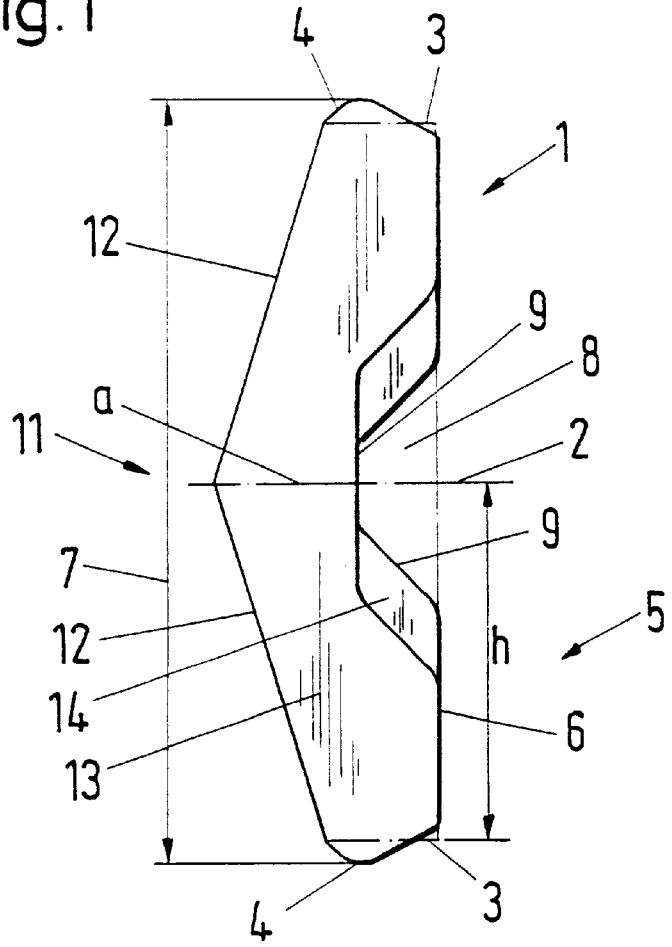
FIG. 1 is a face view of a blow bar according to the invention

As illustrated in FIG. 1, the blow bar 1 has a mirror-symmetrical longitudinal cross-section of basic double trapezium shape corresponding to the dash-dotted lines added. The long bases a of each trapezium body correspond to symmetrical axis 2, the short bases corresponding to the width of the outer surfaces 3.

The impact edges 4 are slightly rounded and slope to the rear. The height h of each trapezium corresponding to the rear 5 of the blow bar 1 is aligned at right angle to the symmetrical axis and thus forms a level surface 6 over the blow bar height 7. On the rear 5 at the level of the symmetrical axis is a trapezium-shaped recess 8, the sides of which are formed by flat support surfaces 9, by means of which the blow bar is supported against the retaining pieces 10 secured provided on the rotor (FIG. 2).

According to FIG. 1, the front 11 of the blow bar features two impact surfaces 12, which are formed by the outwardly-directed sloping sides of the trapezium as obelisk. The groove-like recess 8 features on both faces 13 recesses 14 which widen the groove in which, as shown in FIG. 2, axially effective interlocking elements 15 engage, which are shiftably contained in pockets of the fixed retaining pieces 10.

Figure 2:
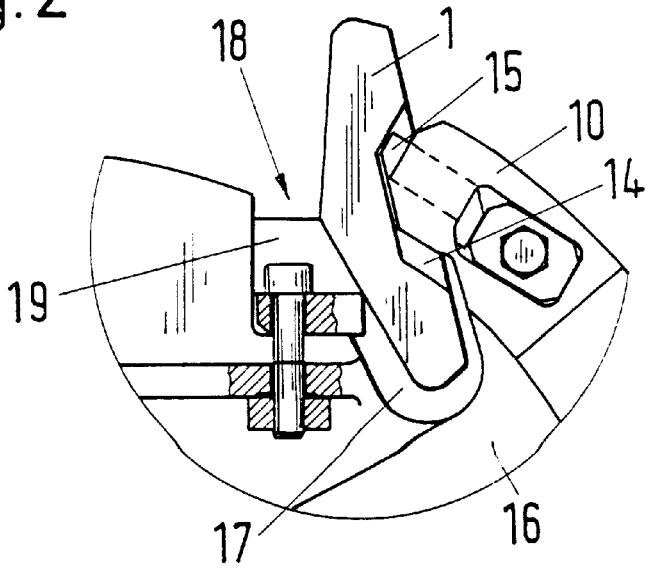
FIG. 2 shows a section of the rotor with a blow bar according to the invention fitted in the rotor

As FIG. 2 shows, the blow bar is fitted with its longitudinal cross-section forwardly inclined in the rotor, which comprises a plurality of rotor discs. The discs feature a plurality of peripheral recesses 17 to accommodate one blow bar. These peripheral recesses are provided in front of the blow bar in the rotation direction of the rotor with a further recess 18 approximately at rightangles for the purpose of accommodating a movable retaining piece 19, which holds the blow bar in engagement with the retaining piece 10 securely provided on the rotor.

Figure 3:
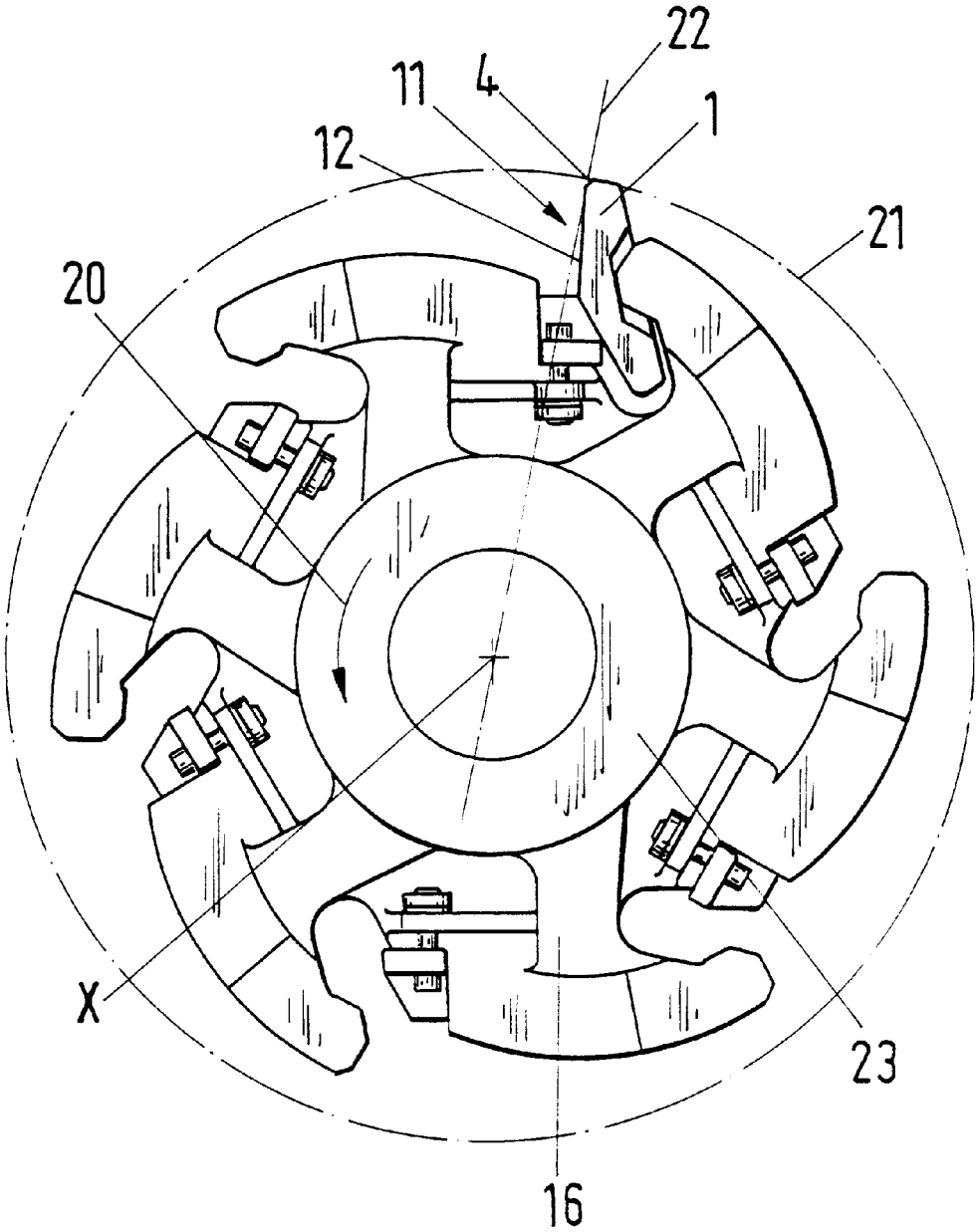
FIG. 3 is a face view of a rotor with fitted blow bar according to the invention

In FIG. 3 is the face view of a rotor, which, for reasons of simplification, is shown with only one blow bar 1. The rotor axis around which the rotor turns according to arrow 20 is marked with an x. The blow bar shown fitted at the top of the figure describes an impact circle 21 with its outer edge 4. Leading from this edge to the rotor axis x is a sectional plane 22. As clearly shown, the blow bar is fitted at an incline to sectional plane 22 in such a way that the impact edge 4 leads with respect to the impact surface 12. The rotor comprises a plurality of rotor discs 16 welded together at their hubs 23.

The blow bar according to the invention is of uncomplicated design and, because of its slender shape, only a relatively small amount of fairly expensive wear material is needed. Fitting and removal thereof is also uncomplicated, contributing to a reduction in maintenance costs.

What is claimed is:

1. A blow bar for impactor rotors, comprising a bar body having a longitudinal cross-section which is mirror symmetrical relative to an axis of symmetry, said bar body having rear surfaces for supporting rearwardly and radially from inside against retaining pieces secured on a rotor, and also front contact surfaces for movable retaining pieces which hold the blow bar in engagement with the retaining pieces secured provided on the rotor, said bar cross-section of said bar body having a shape of a basic double trapezium with a longer base of each trapezium extending at said axis of symmetry, said bar body having a rear which corresponds to a height of each trapezium and is aligned at a right angle to said axis of symmetry so as to form a level surface over a height of said bar body, said bar body also having a groove-shaped recess provided at said rear, said recess running longitudinally in said bar body and being located at a level of said axis of symmetry so as to form said front contact surfaces.

2. A blow bar as defined in claim 1, wherein said body has outer surfaces, each trapezium having a shorter base corresponding to a width of said outer surfaces, and longer bases of each trapezium being approximately twice as long as said shorter base of each trapezium.

3. A blow bar as defined in claim 1, wherein said groove-shaped recess has a trapezium-shaped cross-section.

4. A blow bar as defined in claim 1, wherein said bar body has opposite faces and further recesses which are provided on said opposite faces and widen said groove-shaped recess to accommodate axially effective interlocking elements, said further recesses starting from said rear of said bar body.

5. A blow bar as defined in claim 1, wherein said bar body has a front provided with sloping surfaces of said double trapezium which as obelisk form contact surfaces for movable retaining pieces at the front of the bar body.

6. A rotor arrangement, comprising a blow bar including a bar body having a longitudinal cross-section which is mirror symmetrical relative to an axis of symmetry, said bar body having rear surfaces for supporting rearwardly and radially from inside against retaining pieces secured on a rotor, and also front contact surfaces for movable retaining pieces which hold the blow bar in engagement with the retaining pieces secured on the rotor, said bar cross-section of said bar body having a shape of a basic double trapezium with a longer base of each trapezium extending at said axis of symmetry, said bar body having a rear which corresponds to a height of each trapezium and is aligned at a right angle to said axis of symmetry so as to form a level surface over a height of said bar body, said bar body also having a groove-shaped recess provided at said rear, said recess running longitudinally in said bar body and being located at a level of said axis of symmetry so as to form said front contact surfaces; and a rotor rotatable in a rotation direction and having a rotor axis, said blow bar being fitted slantingly around its longitudinal axis in said rotation direction of said rotor so that a front of an outwardly directed oblique side of said trapezium as which forms an impact surface is forwardly inclined with respect to a sectional plane passing through said rotor axis on an outer most edge of said blow bar forming an impact circle when said rotor is turning, so that said outermost edge is leading with respect to other parts of said blow bar.

7. A rotor for impactors, comprising a plurality of rotor disks which are interrupted by peripheral recesses arranged in alignment with each other in all said rotor disks, said peripheral recesses being inwardly inclined starting from an outer periphery of the rotor opposite to a rotation direction of the rotor; and a blow bar, including a bar body having a longitudinal cross-section which is mirror symmetrical relative to an axis of symmetry, said bar body having rear surfaces for supporting rearwardly and radially from inside against retaining pieces secured on a rotor, and also front contact surfaces for movable retaining pieces which hold the blow bar in engagement with the retaining pieces securely provided on the rotor, said bar cross-section of said bar body having a shape of a basic double trapezium with a longer base of each trapezium extending at said axis of symmetry, said bar body having a rear which corresponds to a height of each trapezium and is aligned at a right angle to said axis of symmetry so as to form a level surface over a height of said bar body, said bar body also having a groove-shaped recess provided at said rear, said recess running longitudinally in said bar body and being located at a level of said axis of symmetry so as to form said front contact surfaces, said peripheral recesses being overlapped by retaining pieces securely provided on the rotor to form a support for said blow bar, so that said blow bar is fitted inclined around its longitudinal axis in said rotation direction of said rotor in such a way that a front of an outwardly directed oblique surface of each trapezium as obelisk forming an impact surface being forwardly inclined with respect to a sectional plane passing through a rotor axis on an outermost edge of said blow bar forming an impact circle when the rotor is turning, so that said outermost edge is leading with respect to other parts of said blow bar.

8. A rotor as defined in claim 7, and further comprising a prism-shaped retaining piece which is securely provided on a rotor level surface and forms a complementary element to said groove-shaped recess in said bar body.

* * * * *